US005645177A

United States Patent [19]

Lin

[11] Patent Number: 5,645,177

[45] Date of Patent: Jul. 8, 1997

[54] TOOL RACK

[76] Inventor: Da-sen Lin, No. 15-6, West Pingnan Lane Lintso Li, Hsitun Dist., Taichung, Taiwan

[21] Appl. No.: 643,611

[22] Filed: May 6, 1996

[51] Int. Cl.[6] ..... A47F 7/00

[52] U.S. Cl. ..... 211/70.6; 206/378; 211/69.5

[58] Field of Search ..... 211/70.6, 69, 68.5, 211/103, 94; 206/349, 350, 376, 377, 378; 403/381; 248/310, 314

[56] References Cited

U.S. PATENT DOCUMENTS

| | | | |
|---|---|---|---|
| 3,405,377 | 10/1968 | Pierce | 206/378 X |
| 3,812,976 | 5/1974 | Rempel | 211/70.6 |
| 4,337,860 | 7/1982 | Carrigan | 206/376 |
| 4,621,738 | 11/1986 | DeLucchi | 206/378 X |
| 4,987,998 | 1/1991 | Tsai | 206/378 X |
| 5,005,710 | 4/1991 | Hofer | 211/70.6 |
| 5,080,230 | 1/1992 | Winnard | 211/70.6 X |
| 5,228,570 | 7/1993 | Robinson | 206/378 |
| 5,232,103 | 8/1993 | Koenig et al. | 211/69.5 |
| 5,263,584 | 11/1993 | Sevey | 206/349 |
| 5,284,245 | 2/1994 | Slivon et al. | 206/378 |
| 5,368,164 | 11/1994 | Bennett et al. | 206/376 X |
| 5,398,823 | 3/1995 | Anders | 206/378 X |
| 5,407,063 | 4/1995 | Warner et al. | 206/378 X |
| 5,447,243 | 9/1995 | Graber | 211/69.5 |
| 5,513,758 | 5/1996 | Lin | 248/314 X |

*Primary Examiner*—Ramon O. Ramirez
*Assistant Examiner*—Sandra Snapp
*Attorney, Agent, or Firm*—Watson Cole Stevens Davis, P.L.L.C.

[57] ABSTRACT

A tool rack includes a rack and a plurality of blocks disposed to the rack, the rack having a T-shaped slot defined longitudinally in a front surface thereof and a bottom surface defining the T-shaped slot, a plurality of notches defined in the bottom surface for engagement with the blocks and each of the notches defined by an inclined surface extending toward the bottom surface and a horizontal bottom, the block including a front part and a rear part which is T-shaped for engagement with the T-shaped slot and has a triangular protrusion extending from a distal end thereof for engagement with the notch, the front part having an engaging device disposed to a distal end thereof for engagement with a tool.

5 Claims, 6 Drawing Sheets

TOOL RACK

BACKGROUND OF THE INVENTION

1. Field of the Invention

The present invention relates to a tool rack and more particularly, to a tool rack having a plurality of blocks disposed thereto and wherein a position of each of the blocks is adjustable.

2. Brief Description of the Prior Art

A conventional tool rack is shown in FIGS. 1 and 2, the rack comprising a base plate 30 and a plurality of engaging members 40 disposed thereto. The base plate 30 has a recessed portion 32 defined longitudinally therein and two edges 31. The engaging member 40 is made of flexible material such as a metal sheet, has dome-like portion 41 and two extending portions extend integrally respectively from each one of two ends of the dome-like portion 41 so as to define a slot portion 42 therein. The base plate 30 is fixed to a wall (not shown) by rivets 33 and the engaging members 40 are respectively mounted to the base plate 30 by receiving the edges 31 in the slot portions 42 of the engaging member 40. A socket 50 is then mounted an open end thereof to the dome-like portion 41 to deform the dome-like portion 41 slightly such that the dome-like portion 41 is biasedly received in socket 50. However, because of gravity, the engaging member 40 together with the socket 50 will slide along the base plate 30. Furthermore, the dome-like portion 41 limits the configuration of the tool to be engaged thereto.

The present invention intends to provide a tool rack having a plurality of blocks disposed thereto and a configuration of each of the blocks is adjustable so as to mitigate and/or obviate the above-mentioned problems.

SUMMARY OF THE INVENTION

The present invention provides a tool rack which includes a rack and a plurality of blocks disposed to the rack. The rack has a T-shaped slot defined longitudinally in a front surface thereof and a bottom surface which defines the T-shaped slot. A plurality of notches are defined in the bottom surface for engagement with the blocks and each of the notches is defined by an inclined surface toward the bottom surface and a horizontal bottom. The block includes a front part and a rear part which is T-shaped for engagement with the T-shaped slot and has a triangular protrusion extending from a distal end thereof for engagement with the notch, the front part having an engaging means disposed to a distal end thereof for engagement with a tool.

It is an object of the present invention to provide a tool rack having a plurality of blocks for engagement with different tools.

It is another object of the present invention to provide a tool rack which can be connected in series.

It is a further object of the present invention to provide a tool rack in which blocks for engagement with tools are adjustably fixed in position.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
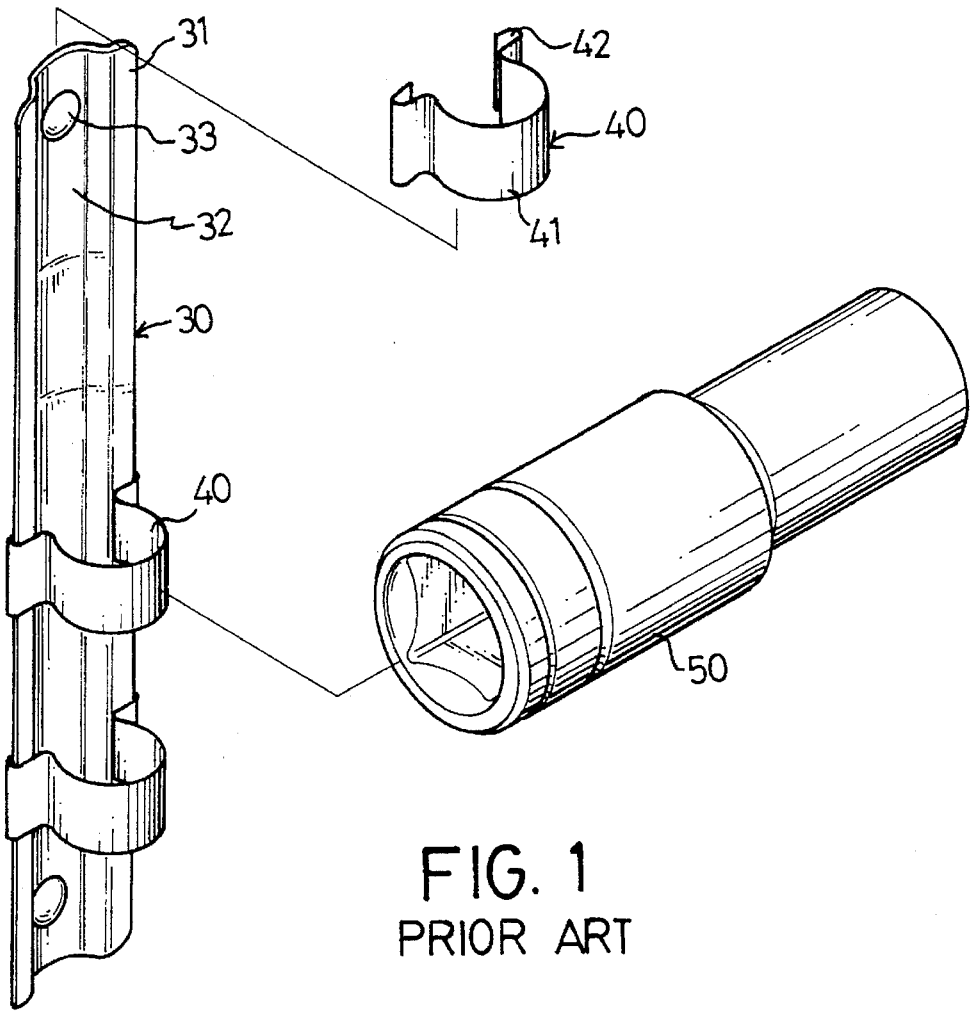
FIG. 1 PRIOR ART
FIG. 1 is an exploded view of a conventional tool rack, engaging members and a socket.
Figure 2:
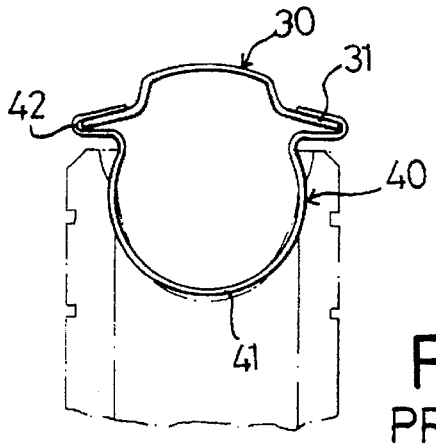
FIG. 2 PRIOR ART
FIG. 2 is a top elevational view of the socket (shown in phantom lines) engaged to the engaging member disposed to the conventional tool rack.
Figure 3:
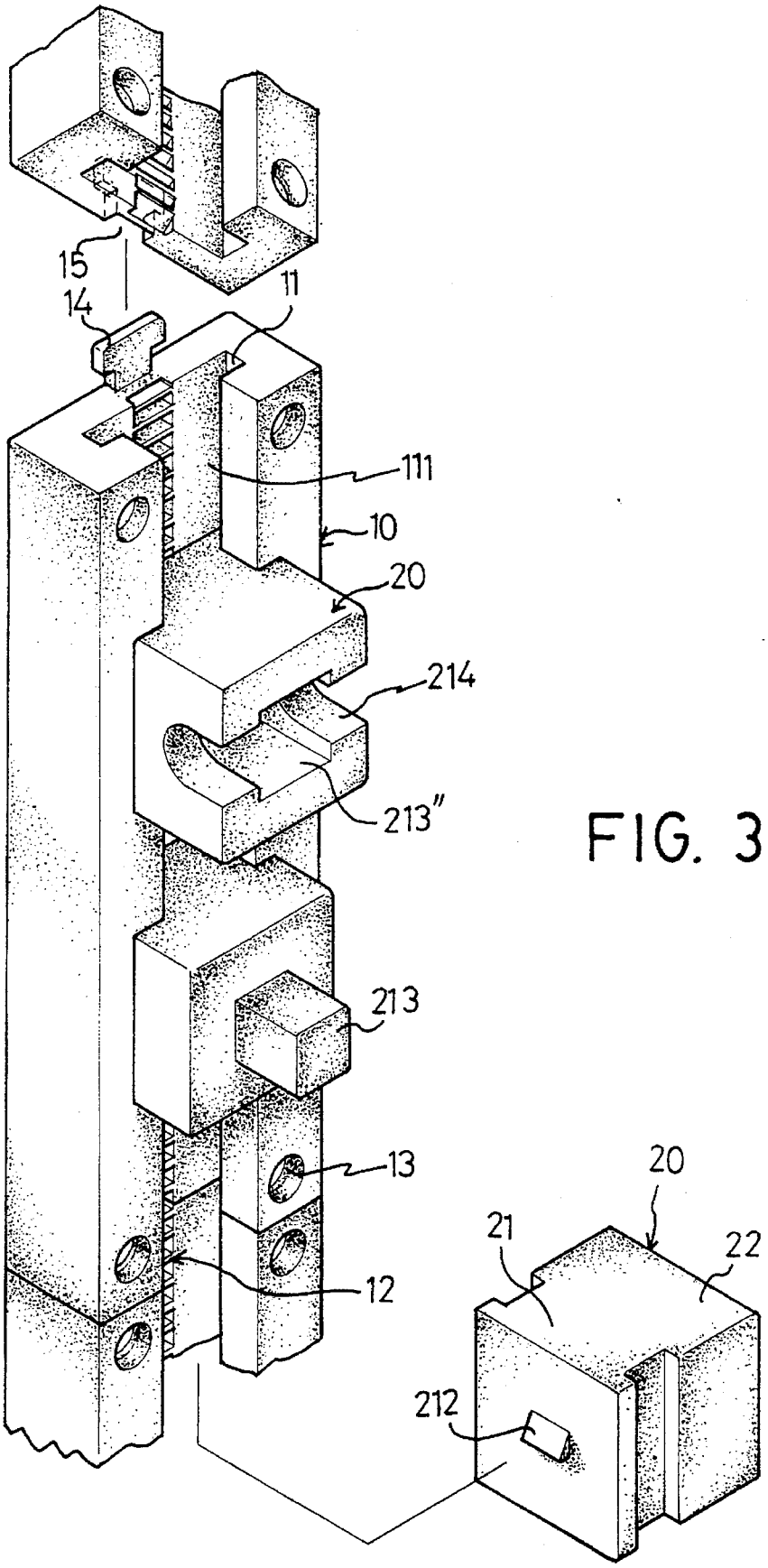
FIG. 3 is an exploded view of three tool racks (only one is completely shown) and three blocks in accordance with the present invention.
Figure 4:
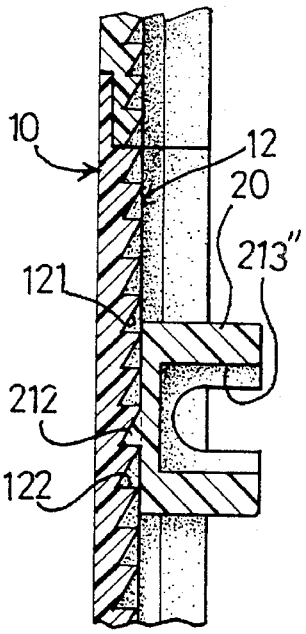
FIG. 4 is a side elevational view, partly in section, of the engagement of two tool racks and a block.

Referring to the drawings and initially to FIGS. 3 and 4, a tool rack in accordance with the present invention generally includes a rack 10 and a plurality of blocks 20 disposed thereto. The rack 10 has a first end and a second end and a T-shaped slot 11 defined longitudinally in a front surface thereof. The T-shaped slot 11 includes a bottom surface 111. A plurality of notches 12 are defined in the bottom surface 111 and each of the notches 12 is defined by an inclined surface 121 extending toward the bottom surface 111 and a horizontal bottom 122.

Figure 5:
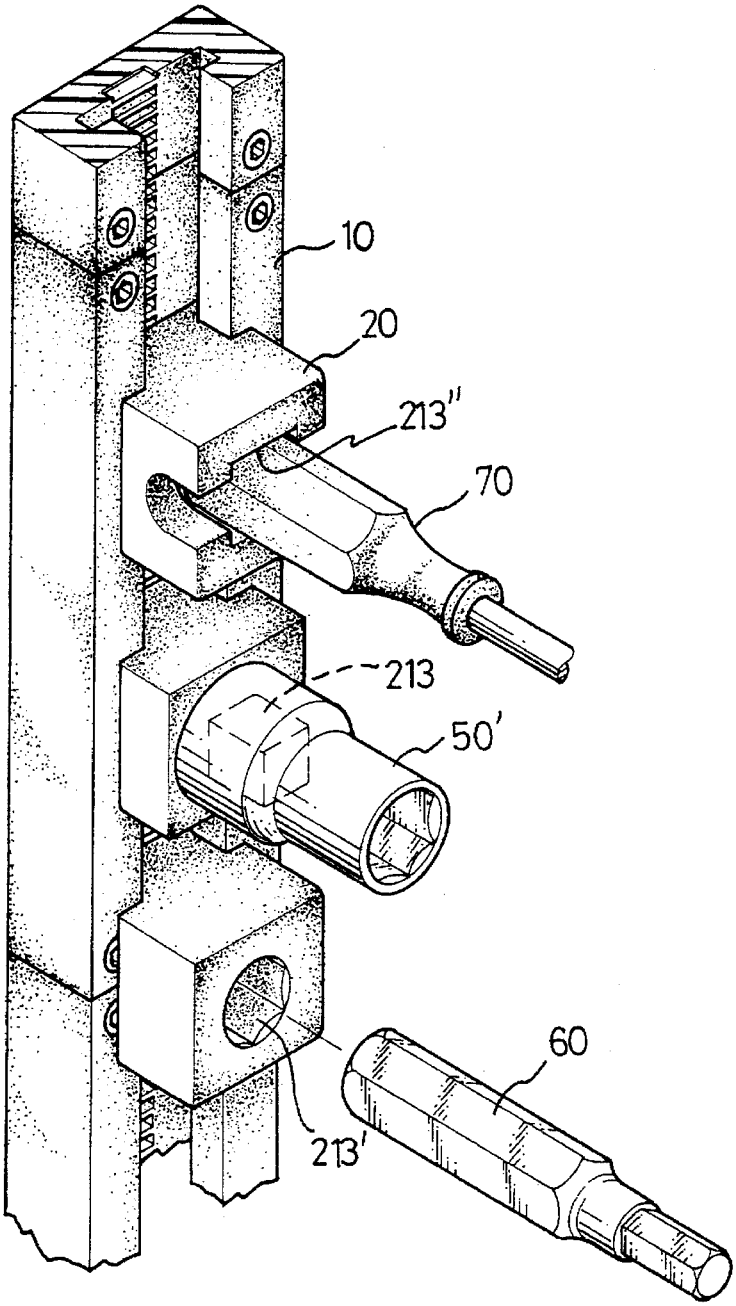
FIG. 5 is a perspective view of three tool racks (only one is completely shown), three blocks disposed to one of the three tool racks and three tools.
Figure 8:
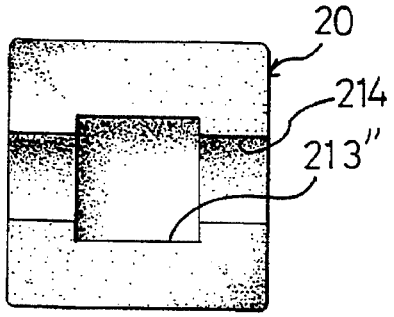
FIG. 8 is a front end plan view to show a first embodiment of the block.

Each of the blocks includes a rear part 21 and a front part 22, the rear part 22 being T-shaped for engagement with the T-shaped slot 11 and having a triangular protrusion 212 extending from a distal end thereof for engagement with the notch 12. The notch 12 defines a triangular recess such that the triangular protrusion 212 can be engaged with the notch 12 with a bottom side of the triangular protrusion 212 disposed on the horizontal bottom 122 so as to prevent the block 20 from dropping downwardly when a tool is disposed to the block 20. Furthermore, the triangular protrusion 212 is made of a resilient material such that the block 20 can be moved upwardly along the notches 12 by sliding an inclined surface of the triangular protrusion 212 along the inclined surface 121 defining the notch 12. The front part 22 has an engaging means disposed to a distal end thereof for engagement with a tool. The engaging means can be a polygonal extension such as a quadratic prism 213 extending therefrom for a socket 50' securely mounted thereto. The engaging means also can be a recess 213' defined therein for tightly receiving a tip 60 therein and the engaging means can be a groove 214 defined transversely therein wherein a rectangular recess 213" is perpendicularly defined in a front surface of the block 20 and communicates with the groove 214 as shown in FIG. 8 such that a handle of a screw driver 70 as shown in FIG. 5 can be received in the rectangular recess 213".

The first end of the rack 10 has a male member 14 extending therefrom and the second end of the rack 10 has a female recess 15 defined therein such that the racks can be connected in series by engaging the male member 14 of one rack 10 into the female recess 15 of the other rack 10. The rack 10 has a hole 13 defined in each of four corners thereof such that the rack 10 can be fixedly disposed to a wall (not shown) as shown in FIG. 5.

Figure 6:
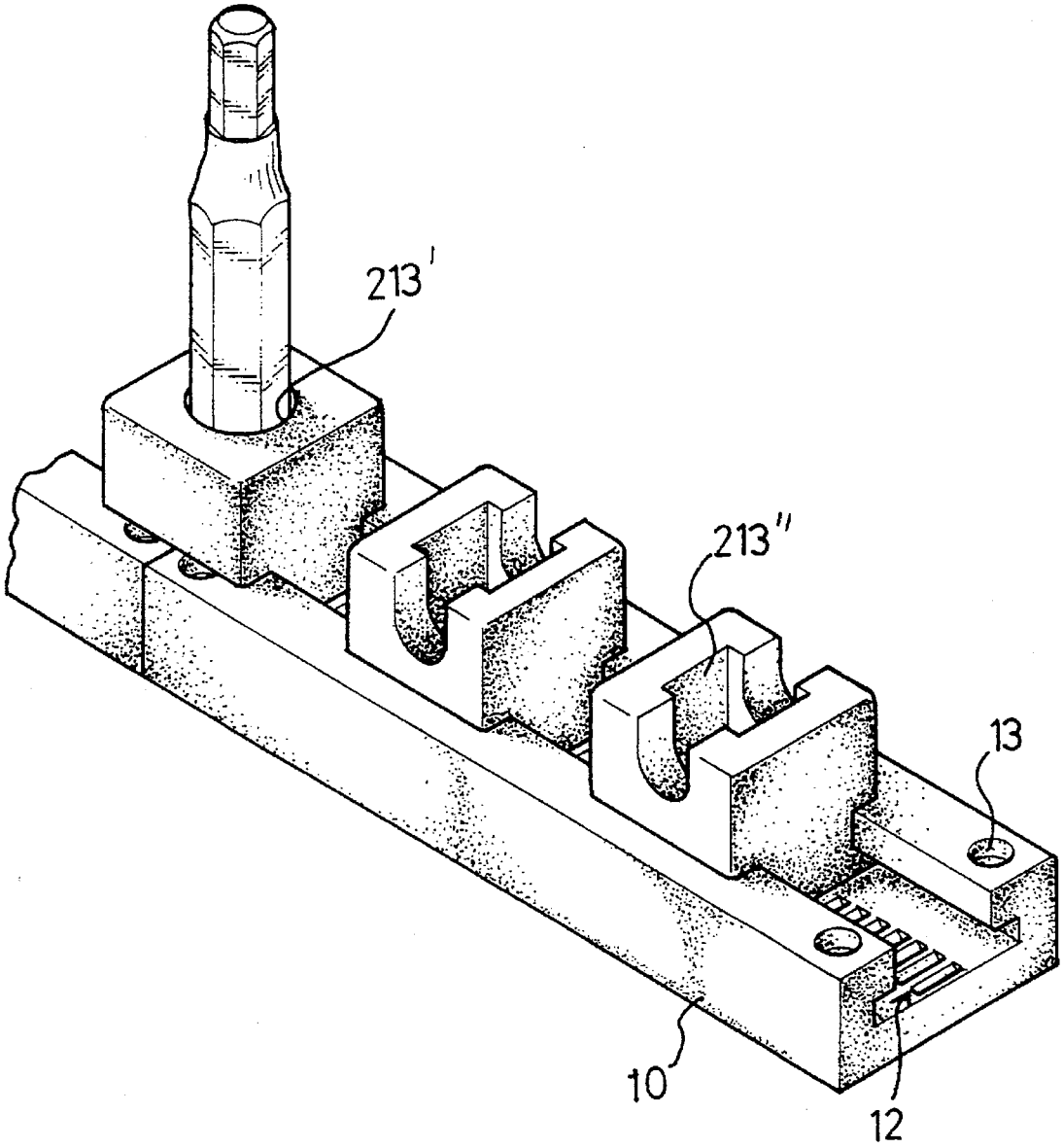
FIG. 6 is a perspective view of two tool racks disposed in a horizontal position with three block disposed thereto.
Figure 7:
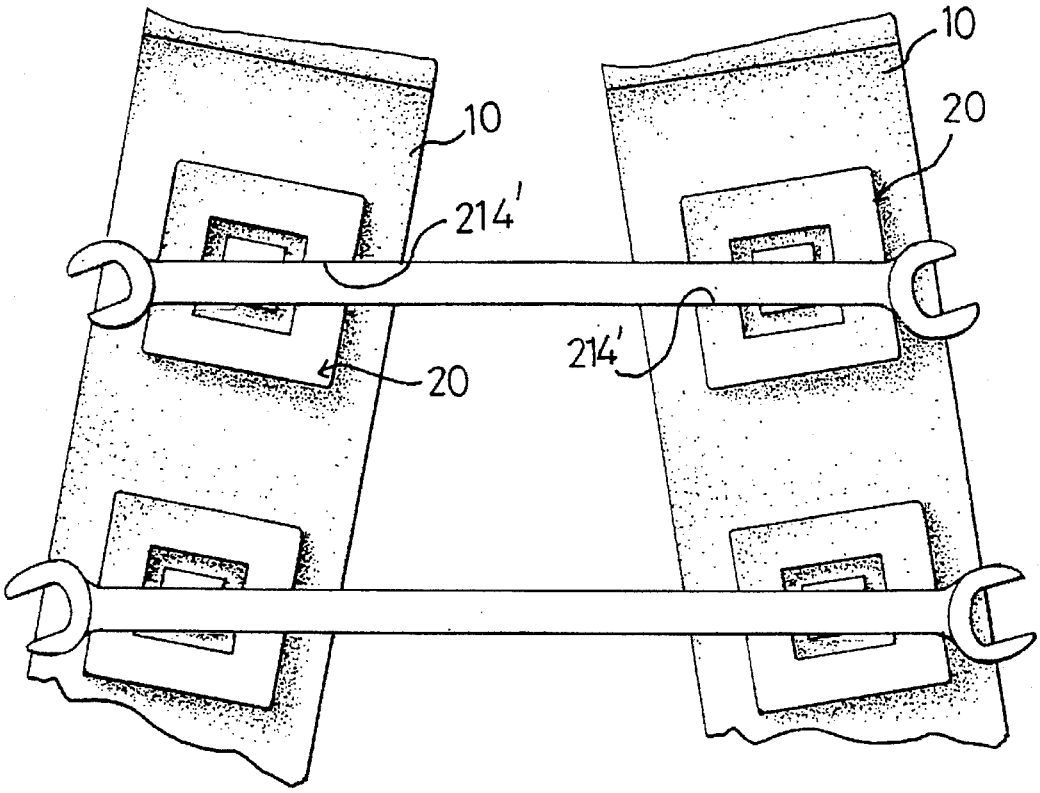
FIG. 7 shows two spanners disposed across two tool racks.

Referring to FIG. 6, the rack 10 can be disposed in a horizontal position by gluing a bottom of the rack 10 to a horizontal wall (not shown) such as a table. FIG. 7 shows two racks 10 are disposed together and the groove 214' of each of the blocks 20 extends inclinedly corresponding to the block 20 such that a spanner can be received in the grooves 214' of the corresponding two blocks 20 of the two racks 20.

Figure 9:
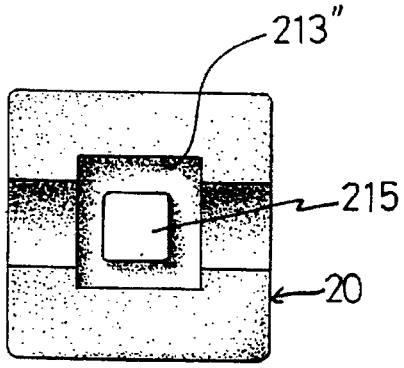
FIG. 9 is a front end plan view to show a second embodiment of the block.
Figure 10:
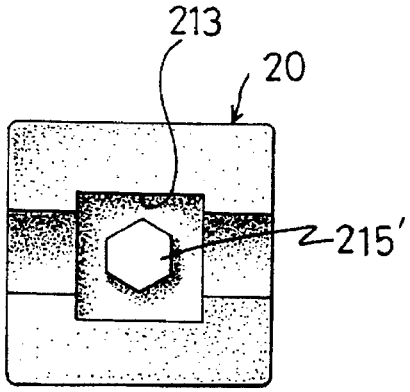
FIG. 10 is a front end plan view to show a third embodiment of the block.

FIG. 9 shows a second embodiment of the block 20 wherein a bottom defining the rectangular recess 213" has a cubic boss 215 extending therefrom and FIG. 10 shows a third embodiment of the block 20 wherein a hexagonal boss 215' extends therefrom.

Although the invention has been explained in relation to its preferred embodiment, it is to be understood that many other possible modifications and variations can be made without departing from the spirit and scope of the invention as hereinafter claimed.

What is claimed is:

1. A tool rack comprising:

a rack having a first end and a second end, said rack having a T-shaped slot defined longitudinally in a front surface thereof and said T-shaped slot including a bottom surface, a plurality of notches defined in said bottom surface and each of said notches defined by an inclined surface extending toward said bottom surface and a horizontal bottom, and at least one block engaged with said T-shaped slot and including a rear part and a front part, said rear part being T-shaped for engagement with said T-shaped slot and having a triangular protrusion extending from a distal end thereof for engagement with said notch, said front part having an engaging means disposed to a distal end thereof, wherein said engaging means of said front part of said block is a plygonal extension extending therefrom.

2. The tool rack as claimed in claim 1, wherein said engaging means of said front part of said block is a recess defined therein.

3. A tool rack comprising:

a rack having a first end and a second end, said rack having a T-shaped slot defined longitudinally in a front surface thereof and said T-shaped slot including a bottom surface, a plurality of notches defined in said bottom surface and each of said notches defined by an inclined surface extending toward said bottom surface and a horizontal bottom, and at least one block engaged with said T-shaped slot and including a rear part and a front part, said rear part being T-shaped for engagement with said T-shaped slot and having a triangular protrusion extending from a distal end thereof for engagement with said notch, said front part having an engaging means disposed to a distal end thereof, wherein said engaging means of said front part of said block is a groove defined therein.

4. A tool rack comprising:

a rack having a first end and a second end, said rack having a T-shaped slot defined longitudinally in a front surface thereof and said T-shaped slot including a bottom surface, a plurality of notches defined in said bottom surface and each of said notches defined by an inclined surface extending toward said bottom surface and a horizontal bottom, and at least one block engaged with said T-shaped slot and including a rear part and a front part, said rear part being T-shaped for engagement with said T-shaped slot and having a triangular protrusion extending from a distal end thereof for engagement with said notch, said front part having an engaging means disposed to a distal end thereof, wherein said first end of said rack has a male member extending therefrom and said second end of said rack has a female recess defined therein.

5. The tool rack as claimed in claim 3, wherein said block has a rectangular recess perpendicularly defined in a front surface thereof and said rectangular recess communicates with said groove, a bottom defining said rectangular recess having a polygonal boss extending therefrom.

* * * * *